US010638857B2

(12) United States Patent
Paris

(10) Patent No.: US 10,638,857 B2
(45) Date of Patent: May 5, 2020

(54) REDEMPTION COUNTER WITH MULTI-COLOR LED FEATURE

(71) Applicant: Steven J Paris, Lakewood, NJ (US)

(72) Inventor: Steven J Paris, Lakewood, NJ (US)

( * ) Notice: Subject to any disclaimer, the term of this patent is extended or adjusted under 35 U.S.C. 154(b) by 126 days.

(21) Appl. No.: 15/853,730

(22) Filed: Dec. 23, 2017

(65) Prior Publication Data

US 2018/0177309 A1 Jun. 28, 2018

Related U.S. Application Data

(60) Provisional application No. 62/439,010, filed on Dec. 24, 2016.

(51) Int. Cl.

| | |
|---|---|
| ***A47F 3/00*** | (2006.01) |
| ***A47F 11/10*** | (2006.01) |
| *F21Y 115/10* | (2016.01) |
| *F21W 131/405* | (2006.01) |
| *F21Y 113/17* | (2016.01) |

(52) U.S. Cl.
CPC ..... *A47F 3/001* (2013.01); *A47F 11/10* (2013.01); *F21W 2131/405* (2013.01); *F21Y 2113/17* (2016.08); *F21Y 2115/10* (2016.08)

(58) Field of Classification Search
CPC .... A47F 11/10; A47F 3/001; F21W 2131/405
See application file for complete search history.

(56) References Cited

U.S. PATENT DOCUMENTS

| | | | | |
|---|---|---|---|---|
| 2004/0177634 | A1* | 9/2004 | Yamazaki | A47F 3/0443 62/248 |
| 2007/0247835 | A1* | 10/2007 | Buelow | A47F 3/001 362/125 |
| 2015/0230631 | A1* | 8/2015 | Nuttall | A47F 7/0071 312/400 |
| 2018/0146798 | A1* | 5/2018 | Artwohl | A47F 3/0434 |

* cited by examiner

*Primary Examiner* — Evan P Dzierzynski
(74) *Attorney, Agent, or Firm* — White-Welker & Welker, LLC; Matthew T. Welker, Esq.

(57) ABSTRACT

Redemption counter and display case comprising a housing with a number of upright and horizontal walls, the housing being adapted to accommodate a plurality of display shelves; wherein the upright and horizontal walls of the housing comprise at least one translucent panel; and a pattern of multicolor LEDs is provided on the inner side of the housing behind this at least one translucent panel, the multicolor LEDs being connected to a control unit for controlling the color emitted by each multicolor LED, which control unit and at least one translucent panel are adapted to impart a determined impression of color to the at least one panel. The control unit of each redemption counter or display case of the assembly is preferably adapted to be able to impart a determined impression of color at the same moment in time, to the panels of each redemption counter or display case.

17 Claims, 2 Drawing Sheets

REDEMPTION COUNTER WITH MULTI-COLOR LED FEATURE

CROSS REFERENCE TO RELATED APPLICATIONS

This application claims priority from U.S. patent application Ser. No. 62/439,010, entitled "Redemption Counter with Multi-Color LED Feature", filed on Dec. 24, 2016. The benefit under 35 USC § 119(e) of the United States provisional application is hereby claimed, and the aforementioned application is hereby incorporated herein by reference.

FEDERALLY SPONSORED RESEARCH

Not Applicable

SEQUENCE LISTING OR PROGRAM

Not Applicable

TECHNICAL FIELD OF THE INVENTION

The present invention relates generally to redemption and display counters. More specifically, the present invention relates to redemption and display counters with lighting features.

BACKGROUND OF THE INVENTION

A variety of shelves have been used inside display cases for the purpose of displaying any number of different items. However, problems are encountered in illuminating such items and drawing attention to the display.

When items are positioned on shelving near the light sources in a display case, undesirable glare or excessively bright regions are formed about the items. This localized area of illumination adversely affects the ability to more uniformly illuminate all products at the front of the shelf. Moreover, glare is a source of distraction that diverts the attention of a viewer or consumer away from a displayed item.

Another common distraction to a consumer or viewer is the heightened contrast created by the uneven amount of illumination across a display case shelf when lighting is located near the ends of the shelves. When viewing a series of adjacent display cases, the alternating high and low intensity lighting across the display case shelving is both distracting and projects an image of non-uniformity. This uneven effect is particularly undesirable.

Problems are also encountered when horizontal fluorescent tubes are mounted inside a display case, and used to light the interior of the case. Some products located inside the case may not be sufficiently illuminated, because these products are located too far away from the light source.

SUMMARY OF THE INVENTION

The present invention has for its object to provide a redemption counter or display case, the appearance of which can be readily modified to the wishes of the user.

According to an embodiment of the invention, the redemption counter or display case, comprises a housing with a number of upright and horizontal walls, wherein the housing is adapted to accommodate a plurality of display shelves; wherein the upright and horizontal walls of the housing comprise at least one translucent panel. The upright and horizontal walls of the housing comprise at least one translucent panel. A pattern of multicolor LEDs is provided inside the housing behind this at least one translucent panel. The multicolor LEDs are connected to a control unit for controlling the color emitted by each multicolor LED. The control unit and the at least one translucent panel are adapted to impart a determined impression of color to the at least one panel.

According to a preferred aspect of the invention, the pattern of multicolor LEDs is arranged such that a substantially uniform impression of color is imparted to the at least one translucent panel. Preferably, the multicolor LEDs are RGB LEDs capable of covering the full color spectrum. In that way, an upright wall of the housing can be given a particular color impression depending on the wishes of the user or the owner of the casino.

According to a preferred embodiment, the upright and horizontal walls of the housing comprise a front wall and a first side wall adjacent the front wall. The front wall comprises at least one lower front panel and a transparent panel mounted above the translucent panel. In a similar way, the first side wall may comprise a translucent lower side panel and a transparent panel mounted above the translucent lower side panel.

According to a further possibility, a corner edge between the front wall and the first side wall may be provided with an elongate profile of a translucent material behind which a pattern of multicolor LEDs is arranged. The control unit and the translucent profile are then typically adapted to impart a determined impression of color to the profile.

According to yet another embodiment of the invention, the redemption counter or display case comprises a housing with a number of upright and horizontal walls and a bottom. The bottom of the housing is a storage area accessible by one or more doors and may also comprises a translucent panel, wherein a pattern of multicolor LEDs is provided on the inner side of the housing above the translucent panel. The multicolor LEDs are connected to a control unit for controlling the color emitted by each multicolor LED. The control unit and the translucent panel are preferably adapted to create a determined colored glow over the bottom of the housing.

According to another embodiment of the invention, the redemption counter or display case comprises a housing with a number of upright and horizontal walls and a translucent horizontal platform inside the housing, wherein the housing is adapted to accommodate a plurality of display shelves. A pattern of multicolor LEDs is provided inside the housing and is connected to a control unit for controlling the color emitted by each multicolor LED. Preferably the pattern of multi-color LEDs is provided under the translucent platform, wherein the control unit and the translucent platform are adapted to impart a determined impression of color to the platform.

BRIEF DESCRIPTION OF THE DRAWINGS

The accompanying drawings, which are incorporated herein a form a part of the specification, illustrate the present invention and, together with the description, further serve to explain the principles of the invention and to enable a person skilled in the pertinent art to make and use the invention.

DETAILED DESCRIPTION OF THE INVENTION

Figure 1:
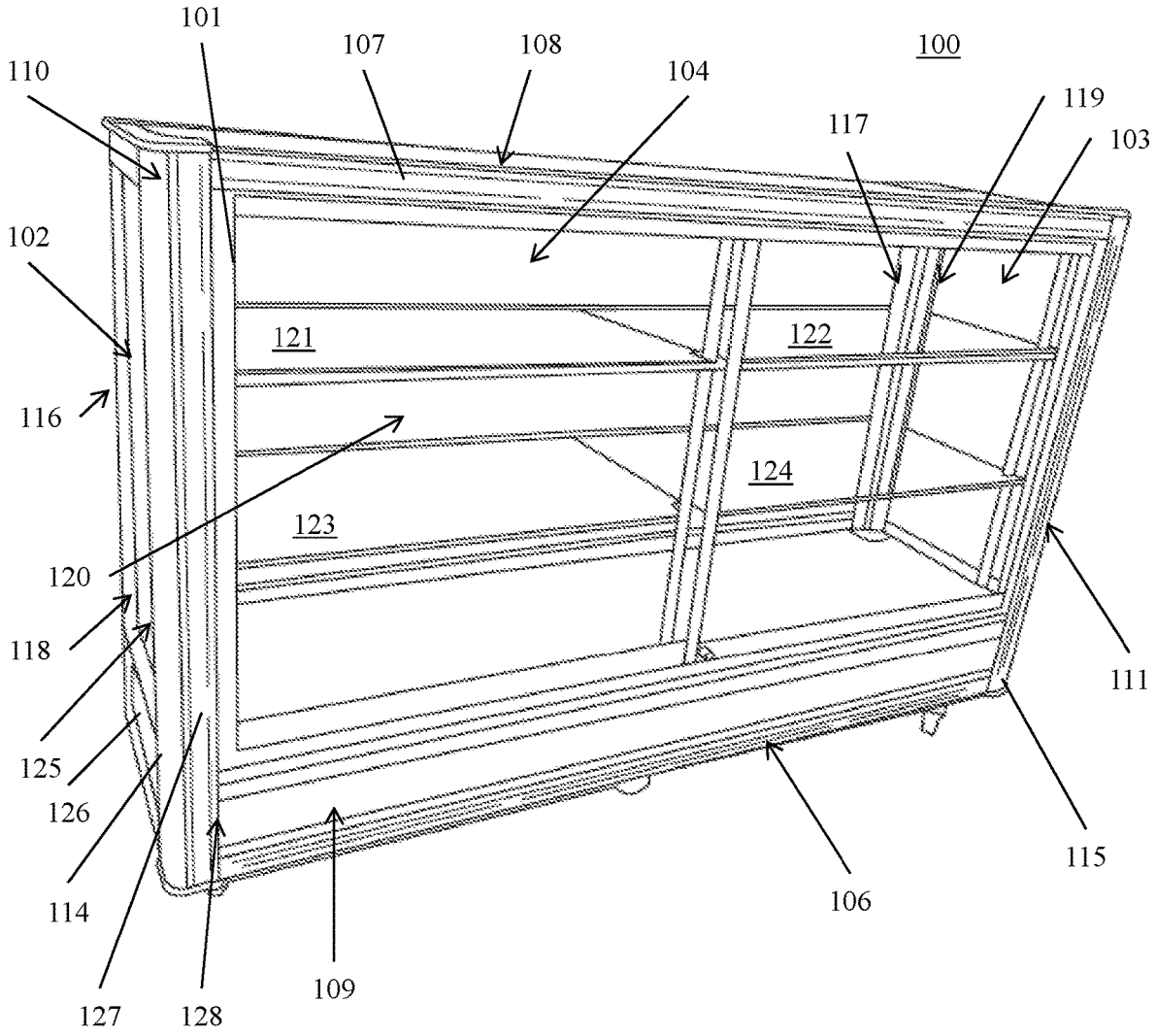
FIG. 1 illustrates a perspective view of a typical redemption or display counter.

In the following detailed description of the invention of exemplary embodiments of the invention, reference is made to the accompanying drawings (where like numbers represent like elements), which form a part hereof, and in which is shown by way of illustration specific exemplary embodiments in which the invention may be practiced. These embodiments are described in sufficient detail to enable those skilled in the art to practice the invention, but other embodiments may be utilized and logical, mechanical, electrical, and other changes may be made without departing from the scope of the present invention.

Not all components are shown or illustrated in the drawings as they are well known in the art and not necessary for one of ordinary skill in the art to make or use the present invention. Drawings of these elements are necessary for the understanding of the subject matter to be patented. The following detailed description is, therefore, not to be taken in a limiting sense, and the scope of the present invention is defined only by the appended claims.

In the following description, numerous specific details are set forth to provide a thorough understanding of the invention. However, it is understood that the invention may be practiced without these specific details. In other instances, well-known structures and techniques known to one of ordinary skill in the art have not been shown in detail in order not to obscure the invention. Referring to the figures, it is possible to see the various major elements constituting the apparatus of the present invention.

Although a specific embodiment of a redemption counter or display case with a plurality of shelves is described here, the skilled person will appreciate that the measures of the invention are also applicable to any other redemption counter or display case in which other decorative means are provided in a cabinet or housing, wherein it is for instance possible to provide a marquee or storage for non-displayed items.

Figure 2:
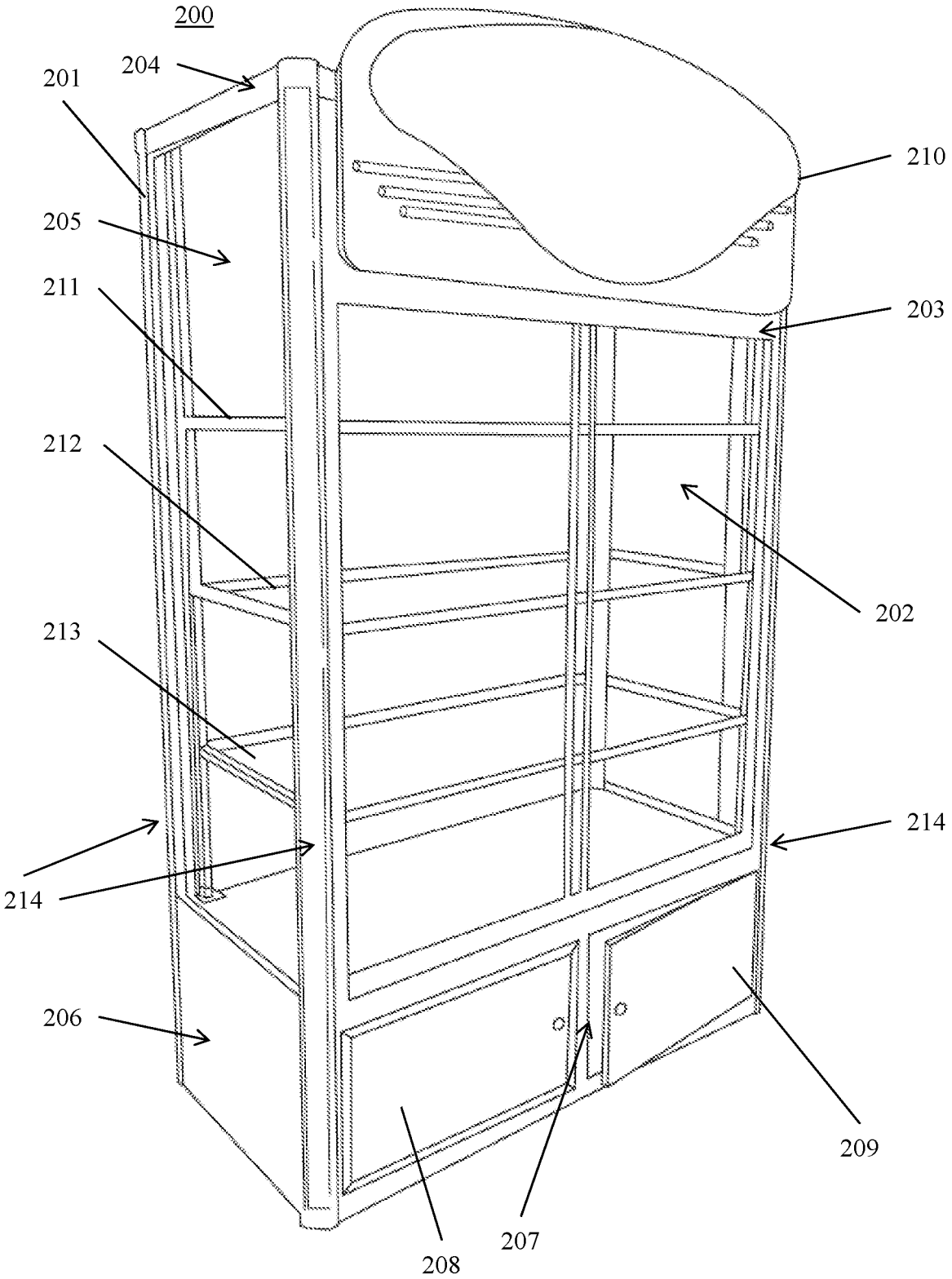
FIG. 2 illustrates a perspective view a typical tall or upright display case.

Now referring to FIGS. 1 & 2, a cabinet 200 or counter 100 consists essentially of a front wall 101, two side walls 102 and 103, a rear wall 104, an upper wall 105, and a bottom 106, each having a corresponding support. The front wall 101 here consists essentially of an upper transparent panel support 107 and a see through panel 108, a lower translucent panel support 109. The front wall 101 also shares corner edge panel supports 110 and 111 with the side walls 120 and 103 which may also be constructed of translucent materials. Each side wall 120 and 103 likewise comprises corner edge transparent panel supports 110 and 111 and either a see through panel or translucent panel 114 and 115.

The rear/back wall 104 also shares corner edge panel supports 116 and 117 with the side walls 120 and 103 which may also be constructed of translucent materials. Each rear/back wall 104 likewise comprises corner edge transparent panel supports 118 and 119 and either a see through panel or translucent panel 120.

Now referring to FIGS. 1 & 2, two embodiments of the present invention are shown. According to an embodiment of the invention, the redemption counter 100 or display case, comprises a housing with a number of upright and horizontal walls, wherein the housing is adapted to accommodate a plurality of display shelves 121, 122, 123, and 124; wherein the upright and horizontal walls of the housing comprise at least one translucent panel. The upright and horizontal walls of the housing comprise at least one translucent panel. A pattern of multicolor LEDs is provided inside the housing behind this at least one translucent panel. The multicolor LEDs are connected to a control unit for controlling the color emitted by each multicolor LED. The control unit and the at least one translucent panel are adapted to impart a determined impression of color to the at least one panel.

According to a preferred aspect of the invention, the pattern of multicolor LEDs is arranged such that a substantially uniform impression of color is imparted to the at least one translucent panel. Preferably, the multicolor LEDs are RGB LEDs capable of covering the full color spectrum. In that way, an upright wall of the housing can be given a particular color impression depending on the wishes of the user or the owner of the casino.

According to a preferred embodiment of the invention, the at least one translucent panel is manufactured from a material with a light transmission lying between 10% and 60%, preferably between 20% and 50%, and more preferably between 35% and 45%. The at least one translucent panel is preferably manufactured from a white translucent material having good light diffusion properties. Typically the material of the translucent panel has a light diffusion factor lying between 0.70 and 1.00.

According to a further aspect of the invention, the at least one translucent panel may comprises a translucent panel with a relief, wherein a pattern of multicolor LEDs is arranged in this relief. According to a possible embodiment, the pattern of multicolor LEDs is arranged along the edge of this relief, and such that the central emission direction of the LEDs is directed substantially toward the inner side of the relief.

Now referring to FIG. 1, according to a preferred embodiment, the pattern of multicolor LEDs is arranged such that the central emission direction of each LED thereof is substantially parallel to the translucent panel behind which the LED is provided. In that way light spots on the panel are avoided and a substantially uniform impression of color is imparted to the panel.

According to a preferred embodiment, the upright and horizontal walls of the housing comprise a front wall 101 and a first side wall 102 adjacent the front wall 101. The front wall 101 comprises at least one first lower front panel 108 and a second transparent panel 125 mounted above the first lower translucent panel 108. In a similar way, the first side wall 102 may comprise a translucent lower side panel 126 and a transparent panel 127 mounted above the translucent lower side panel 126.

According to a further possibility, an edge 128 between the front wall 101 and the first side wall 102 may be provided with an elongate profile of a translucent material behind which a pattern of multicolor LEDs is arranged. The control unit and the translucent profile are then typically adapted to impart a determined impression of color to the profile.

According to another embodiment of the invention, the redemption counter or display case comprises:

- a housing having a number of upright and horizontal walls comprising at least one translucent panel;
- one or more clear panels for seeing displayed on one or more shelves retained by the walls; and
- a pattern of multicolour LEDs being provided inside the housing behind the at least one translucent panel, the multicolour LEDs being connected to a control unit for controlling the color emitted by each multicolour LED.

Now referring to FIG. 2, according to yet another embodiment of the invention, the redemption counter or display case/cabinet 200 comprises a housing 201 with a number of upright and horizontal walls 202, 203, 204, and 205 and a bottom 206. The bottom 206 of the housing 201 is a storage area 207 accessible by one or more doors 208 and 209 and may also comprises one or more translucent panels 214, wherein a pattern of multicolor LEDs is provided on the inner side of the housing 201 above the translucent panel. The multicolor LEDs are connected to a control unit for controlling the color emitted by each multicolor LED. The control unit and the translucent panel are preferably adapted to create a determined colored glow over the bottom 2096 of the housing 201.

According to another embodiment of the invention, the redemption counter or display case/cabinet 20 comprises a housing 201 with a number of upright and horizontal walls 202-205 and a translucent horizontal platform 210 inside the housing 201, wherein the housing 201 is adapted to accommodate a plurality of display shelves 211, 212, and 213. A pattern of multicolor LEDs is provided inside the housing 201 and is connected to a control unit for controlling the color emitted by each multicolor LED. Preferably the pattern of multi-color LEDs is provided under the translucent platform 210, wherein the control unit and the translucent platform are adapted to impart a determined impression of color to the platform 210.

According to another object of the invention, there is provided an assembly of at least two machines as disclosed above. The control unit of each redemption counter or display case of the assembly is preferably adapted to be able to impart a determined impression of color at the same moment in time, to the panels of each redemption counter or display case of the assembly. The impression of color can differ for one or more redemption counter or display cases of the at least two redemption counter or display cases.

According to a possible embodiment of the assembly of the invention, a synchronization unit is provided. The synchronization unit is coupled to each control unit for the purpose of synchronizing each control unit with that of an adjacent redemption counter or display case.

Thus, it is appreciated that the optimum dimensional relationships for the parts of the invention, to include variation in size, materials, shape, form, function, and manner of operation, assembly and use, are deemed readily apparent and obvious to one of ordinary skill in the art, and all equivalent relationships to those illustrated in the drawings and described in the above description are intended to be encompassed by the present invention.

Furthermore, other areas of art may benefit from this method and adjustments to the design are anticipated. Thus, the scope of the invention should be determined by the appended claims and their legal equivalents, rather than by the examples given.

The embodiments of the invention in which an exclusive property or privilege is claimed are defined as follows:

1. A display case used for displaying items, the display case comprising:

a surrounding frame;

the surrounding frame comprising a front wall, two side walls, a rear wall, an upper wall, and a bottom, each having a corresponding edge support;

the front wall here consists essentially of an upper transparent panel support and a see through panel, a lower translucent panel support;

the front wall also shares corner edge panel supports with the side walls which may also be constructed of translucent materials;

each side wall likewise comprises corner edge transparent panel supports and either a see through panel or translucent panel;

the back wall also shares corner edge panel supports with the side walls which may also be constructed of translucent materials;

each back wall likewise comprises corner edge transparent panel supports and either a see through panel or translucent panel;

a pattern of multicolor LEDs is provided inside the surrounding frame behind this at least one translucent panel;

the multicolor LEDs are connected to a control unit for controlling the color emitted by each multicolor LED; and a control unit and the at least one translucent panel are adapted to impart a determined impression of color to the at least one panel.

2. The display case of claim 1, wherein the surrounding frame is adapted to accommodate a plurality of display shelves;

the upright and horizontal walls of the surrounding frame comprise at least one translucent panel; and the upright and horizontal walls of the surrounding frame comprise at least one translucent panel.

3. The display case of claim 1, wherein the pattern of multicolor LEDs is arranged such that a substantially uniform impression of color is imparted to the at least one translucent panel.

4. The display case of claim 3, wherein the multicolor LEDs are RGB LEDs capable of covering the full color spectrum.

5. The display case of claim 3, wherein the at least one translucent panel is manufactured from a material with a light transmission lying between 10% and 60%.

6. The display case of claim 5, wherein the at least one translucent panel is preferably between 20% and 50%, and more preferably between 35% and 45%.

7. The display case of claim 5, wherein the at least one translucent panel is preferably manufactured from a white translucent material having good light diffusion properties.

8. The display case of claim 7, wherein the material of the translucent panel has a light diffusion factor lying between 0.70 and 1.00.

9. The display case of claim 1, wherein the at least one translucent panel may comprises a translucent panel with a relief, wherein a pattern of multicolor LEDs is arranged in this relief.

10. The display case of claim 9, wherein the pattern of multicolor LEDs is arranged along the edge of this relief, and such that the central emission direction of the LEDs is directed substantially toward the inner side of the relief.

11. The display case of claim 1, wherein the pattern of multicolor LEDs is arranged such that the central emission direction of each LED thereof is substantially parallel to the translucent panel behind which the LED is provided.

12. The display case of claim 1, wherein the upright and horizontal walls of the surrounding frame comprise a front wall and a first side wall adjacent the front wall;

the front wall comprises at least one lower front panel and a transparent panel mounted above the translucent panel; and the first side wall comprise a translucent lower side panel and a transparent panel mounted above the translucent lower side panel.

13. The display case of claim 1, wherein an edge between the front wall and the first side wall may be provided with an elongate profile of a translucent material behind which a pattern of multicolor LEDs is arranged; and the control unit and the translucent profile are then typically adapted to impart a determined impression of color to the profile.

14. The display case of claim 1, wherein the redemption counter or display case comprises a surrounding frame with a number of upright and horizontal walls and a bottom;

the bottom of the surrounding frame is a storage area accessible by one or more doors and may also comprises a translucent panel, wherein a pattern of multicolor LEDs is provided on the inner side of the surrounding frame above the translucent panel;

the multicolor LEDs are connected to a control unit for controlling the color emitted by each multicolor LED; and the control unit and the translucent panel are preferably adapted to create a determined colored glow over the bottom of the surrounding frame.

15. The display case of claim 1, wherein the redemption counter or display case comprises a surrounding frame with a number of upright and horizontal walls and a translucent horizontal platform inside the surrounding frame, wherein the surrounding frame is adapted to accommodate a plurality of display shelves;

a pattern of multicolor LEDs is provided inside the surrounding frame and is connected to a control unit for controlling the color emitted by each multicolor LED; and the pattern of multi-color LEDs is provided under the translucent platform, wherein the control unit and the translucent platform are adapted to impart a determined impression of color to the platform.

16. The display case of claim 1, wherein the control unit of each redemption counter or display case of the assembly is preferably adapted to be able to impart a determined impression of color at the same moment in time, to the panels of each redemption counter or display case of the assembly; and the impression of color can differ for one or more redemption counter or display cases of the at least two redemption counter or display cases.

17. The display case of claim 1, wherein a synchronization unit is provided;

the synchronization unit is coupled to each control unit for the purpose of synchronizing each control unit with that of an adjacent redemption counter or display case.

* * * * *